United States Patent [19]

Gagnon

[11] Patent Number: 5,050,323

[45] Date of Patent: Sep. 24, 1991

[54] BADGE

[75] Inventor: Raymond Gagnon, Montreal, Canada

[73] Assignee: Badgeco, Inc., Montreal, Canada

[21] Appl. No.: 396,946

[22] Filed: Aug. 22, 1989

Related U.S. Application Data

[63] Continuation-in-part of Ser. No. 85,309, Aug. 10, 1987, Pat. No. 4,858,358, which is a continuation of Ser. No. 596,503, Apr. 3, 1984, abandoned.

[51] Int. Cl.[5] ..... A44C 3/00

[52] U.S. Cl. ..... 40/1.5; 40/616

[58] Field of Search ..... 40/1.5, 616

[56] References Cited

U.S. PATENT DOCUMENTS

| | | | |
|---|---|---|---|
| 990,426 | 4/1911 | Dewes . | |
| 1,082,986 | 12/1913 | Wilder . | |
| 2,603,899 | 2/1946 | Leander | 40/125 |
| 2,975,538 | 4/1960 | Murfin | 40/20 |
| 2,988,835 | 6/1961 | Murphy | 40/135 |
| 3,257,747 | 5/1963 | Schimmel | 40/1.5 |
| 3,350,799 | 10/1965 | Japs | 40/2 |
| 3,546,797 | 2/1968 | Oleson | 40/1.5 |
| 3,889,407 | 6/1975 | Elzer | 40/2 R |
| 3,931,688 | 1/1976 | Owens | 40/1.5 |
| 3,996,679 | 12/1976 | Warneke | 40/1.5 |
| 4,338,737 | 7/1982 | Lehmann | 40/1.5 |
| 4,377,050 | 3/1983 | Renholts | 40/615 |

FOREIGN PATENT DOCUMENTS 2282335 3/1976 France .

*Primary Examiner*—Cary E. Stone

*Attorney, Agent, or Firm*—Eckert, Seamans, Cherin & Mellott

[57] ABSTRACT

A badge for wearing on one's clothes or on any other surface, made of a body layer of synthetic foam and material of the type having no memory when compressed, the body layer carrying an image on its front face and fastening means at its back face. The body layer has a marginal portion of smaller thickness than that of the central portion of the body layer, with the foam material exposed at the periphery of the body layer.

10 Claims, 2 Drawing Sheets

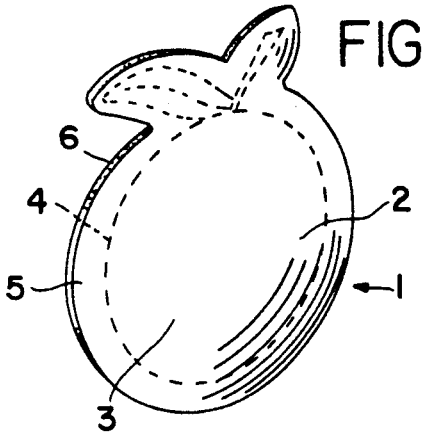
FIG. 1
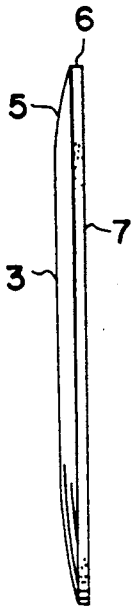
FIG. 2
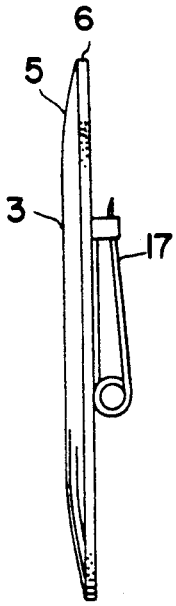
FIG. 3
FIG. 4
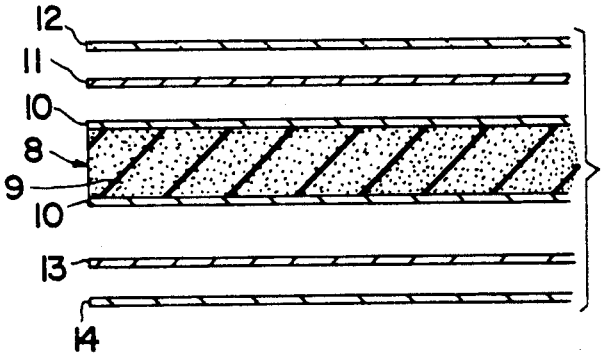
FIG. 5
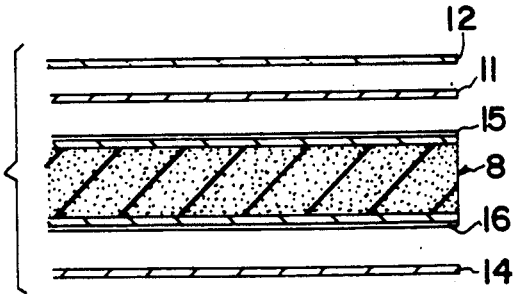

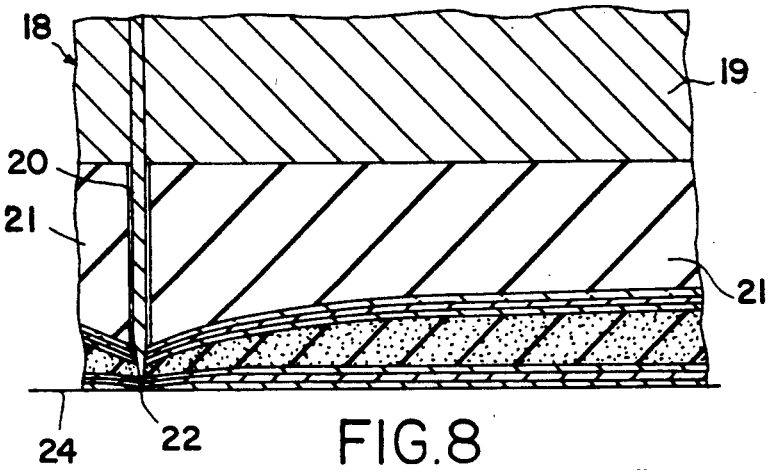
FIG.8
FIG.6
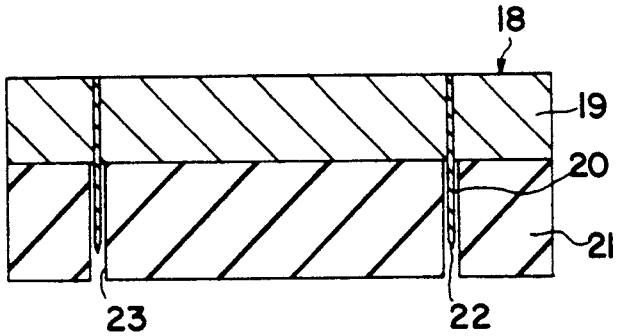
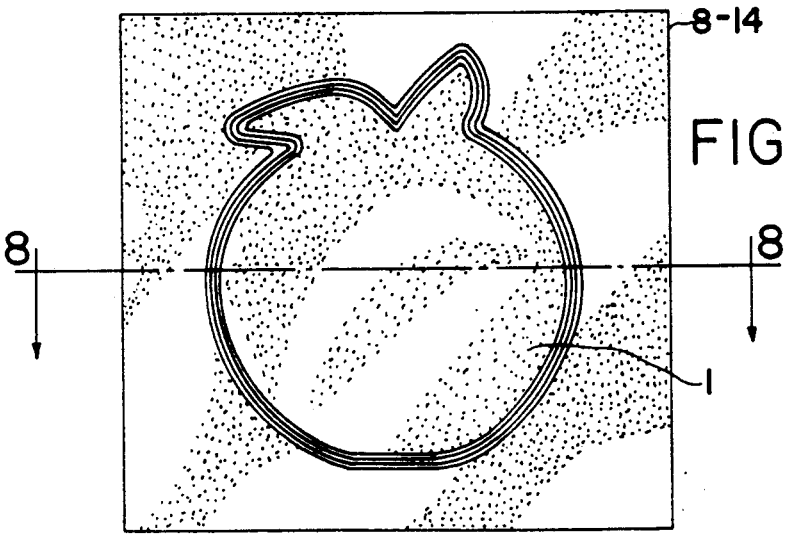
FIG.7

BADGE

CROSS REFERENCE TO RELATED APPLICATIONS

This is a continuation-in-part of application Ser. No. 085,309, filed Aug. 10, 1987, now U.S. Pat. No. 4,858,358, which is a continuation of application Ser. No. 596,503, filed Apr. 3, 1984, now abandoned.

BACKGROUND OF THE INVENTION

1. Field of the Invention

The present invention relates to a badge and to a method of making the same, and more particularly to a badge wherein a marginally compressed synthetic foam material between front and back face of the badge produces a bulging front contour resembling standard metal badges.

2. Prior Art

U.S. Pat. No. 4,338,737 dated July 13, 1982 to Roger W. Lehmann describes a badge made of a body layer of foam plastic and covered at its front and back faces with a sheet of plastic material which are heat sealed together at their marginal edges. This construction is relatively expensive, since the foam plastic material has first to be cut out to the desired contour. Then the wall sheets have to be cut out to a slightly greater size and then assembled with the body layer and, finally, the resulting assembly subjected to a heat-sealing operation.

The Lehmann patent as well as the present invention represent badges that are improvements on the known standard metal badge, and have an external appearance to persons viewing the badge which is at least somewhat similar to the standard metal badge. The standard metal badge is formed from a piece of sheet metal, cut out and stamped such that the front face is slightly bulging. The front face is covered by drawings, lettering or the like, usually in bright colors. The edges of the metal badge are rounded and the rear side of the badge has a pin or the like such that the badge can be fixed to the wearer's clothing.

According to one example of such standard metal badges, the sheet metal piece is formed such that the face not only bulges, but the peripheral edges are turned rearward in a curving configuration which defines a receptacle for an inserted base member of complementary shape. The base member carries the pin or the like and the base member can be forced into the receptacle defined on the rear of the sheet metal piece, or held captive when the peripheral edges are turned back. A sheet of paper, plastic or the like can be placed over the front of the sheet metal piece and wrapped under the peripheral edges to be caught between the sheet metal piece and the base member. Alternatively, the front can be printed or painted directly. In any event, the standard badge, which is well known and accepted by consumers, has a bulging front configuration for receiving the drawings or text to be displayed. This bulging shape has the benefit of allowing the badge to be more visible than a flat badge or even a relatively thick flat badge. The bulging shape also provides a rounded or tapered configuration that is not prone to catch on the wearer's sleeves, etc., when worn on the breast.

SUMMARY OF THE INVENTION

The general object of the present invention is to provide a badge and a method of making the same, which is much less expensive than in the above-mentioned Lehmann patent.

Another object of the invention is to provide a badge which has the appearance of and which imitates, to a certain extent, the standard metal badges with a tapered contour.

Another object of the present invention is to provide a badge of very light weight construction and which will resist wear and tear.

The badge of the invention satisfies these objectives in that the badge comprises a layer of synthetic foam material of the type having no memory when compressed, an image-bearing layer adhering to the front face of said body layer, fastening means carried by the back face of said body layer to attach the body layer to the wearer's clothing, the foam material being exposed all around the peripheral edge of said body layer, the marginal portion of said badge having a smaller thickness than the central portion of said badge. The method of the invention comprises providing a laminate formed of the above-noted layers, positioning said laminate on a flat surface and applying a cutting blade against the front surface of said laminate, which not only cuts out the badge from the laminate but also compresses the laminate material in the area of the cutting blade Consequently, the resulting badge remains with its marginal portion in permanent compressed condition, due to the fact that the foam material used has no memory and will not come back to its original non-compressed condition.

From the foregoing, it is seen that the badge can be made in one single operation once the various layers of the laminate have been assembled.

BRIEF DESCRIPTION OF THE DRAWINGS

FIG. 1 is a perspective view of an example of the badge in accordance with the invention;

FIG. 2 is a side elevation;

FIG. 3 is a side elevation of a badge with a different type of fastening means;

FIG. 4 is an exploded cross-sectional view showing the various layers composing one embodiment of the laminate used to make the badge in accordance with the invention;

FIG. 5 is a view similar to that of FIG. 4 but showing another embodiment of the laminate;

FIG. 6 is a cross-sectional view of the cutting and compressing die used to make the badge of the invention;

FIG. 7 is a plan view of the laminate with the badge cut out;

FIG. 8 is a cross-sectional view of the laminate, also taken along line 8—8 of FIG. 7 but also showing the compressing and cutting die at the end of its compressing and cutting stroke.

In the drawings, like reference characters indicate like elements throughout.

DETAILED DESCRIPTION OF THE PREFERRED EMBODIMENTS

The badge 1 of FIGS. 1 and 2 is shown in its completed condition ready to be used. It has at its front face 2 a central area 3 delimited by the dotted line 4 and a marginal portion 5 outside the dotted line. The edge of the badge is shown at 6. The back face 7 of the badge is flat and, as shown in FIG. 2, the marginal portion 5 tapers towards the edge 6, so that the marginal portion 5 has a smaller thickness than that of the central area 3 of the badge 1.

FIG. 4 shows one embodiment of the laminate to make the badge 1. The laminate consists of a body layer 8, which is made of a synthetic foam material, indicated at 9, of the type having no memory when compressed so that, once compressed, it stays in this compressed condition. A typical example of such a foam material is expanded polystyrene, preferably such a foam material sandwiched between two paper layers, indicated at 10. Such a body layer may, for instance, have a thickness of two tenths of an inch. Such a body layer is made by Monsanto Inc. and marketed under the registered trade mark FOME COR. An image-bearing layer 11 is adhered to the front face of the body layer 8 and a transparent film 12 is in turn adhered to the image-bearing layer 11. At the back face of the body layer, a sheet of paper 13 or of plastic, coated on both sides with a pressure adhesive, is adhered to the body layer 8 and a peelable protecting film 14 is adhered to the exposed face of the pressure adhesive to complete the laminate.

FIG. 5 shows an alternative embodiment of the laminate. The same body layer 8 is used, together with the image-bearing layer 11 and the protective transparent film 12 at the front face. The image-bearing paper is glued onto the paper layer 10 of the body layer 8 by means of liquid glue, indicated at 15. In this embodiment, the sheet of double-coated pressure adhesive 13 is replaced by a single layer of pressure adhesive 16 applied in liquid form to the back of the body layer 8. Once the peelable film 14 at the back of the badge is removed, the badge can be adhered to one's clothing by the exposed pressure adhesive of strip 13, or of layer 16.

This exposed pressure adhesive constitutes the fastenting means for the badge. However, this fastening means can be replaced by a metal safety clip, of conventional construction, as shown at 17 in FIG. 3. The assembled laminate is cut out to form the badge in a single operation. For this purpose, the cutting and compressing die, shown in cross-section in FIGS. 6 and 8, is used. This die, generally indicated at 18, includes a rigid backing block 19, a cutting blade 20 and a layer of compressible material 21. The cutting blade 20 is fixed to and protrudes from one face of the block 19, having an exposed cutting edge 22. This cutting blade 20 normally extends to the top surface of block 19 and is longitudinally shaped in accordance with the desired final contour of the badge 1 to be made. The layer 21 of compressible material is adhered to block 19 on the same face from which the cutting blade 20 protrudes. The layer 21 may be made of rubber and it extends on the outside as well as on the inside of the closed figure formed by the cutting blade 20, with a suitable slot 23 formed in the layer 21 in which the cutting blade freely extends. In its non-compressed condition, the layer 21 protrudes at its outer face from the cutting edge 22 of blade 20, as shown in FIG. 6.

The above-described laminate of either FIG. 1 or 5 is supported on a flat supporting surface 24, as shown in FIG. 8, and the die 18 is pressed against the laminate. The top face of the laminate is engaged by the compressible layer 21 and is pressed in place while the cutting blade 20 cuts through the laminate in accordance with the desired contour of the badge 1. Due to the pressing action of the cutting blade, the foam core 9 of the body layer 8 is compressed on each side of the blade 20, and since this foam 9 has no memory, it remains in compressed condition, therefore defining the compressed marginal portion 5 of the finished badge 1. After the die cutting operation, the badge is already in its completed condition, with the foam layer 8 being exposed at the edge 6 of the badge. However, since the blade has a much reduced thickness at its marginal portion, the exposed foam is hardly visible and will not detract from the general appearance of the badge. Obviously, several badges can be cut out simultaneously from a single sheet of laminate, with the images properly spaced at the top face of the laminate, in which case the die would include several cutting blades 20 adapted to register with the respective images.

What is claimed is:

1. A badge comprising:

a body layer of synthetic foam material comprising a central portion and a marginal portion which extends all around said central portion and has a smaller thickness than that of said central portion, said body layer having a front face, a back face and a peripheral edge, said front face sloping toward said back face at said marginal portion to define said smaller thickness and give said front face a generally bulging configuration;

an image-bearing layer adhering to the front face of said body layer, and fastening means carried by the back face of said body layer to attach said body layer to a wearer's clothing; wherein:

the foam material forming the body layer is of the type having no memory when compressed;

said foam material is left exposed at the peripheral edge of said body layer; and, said badge further comprises a protecting transparent film covering said image-bearing layer.

2. A badge as defined in claim 1, wherein said fastening means has a layer of pressure adhesive applied to said back face of said body layer.

3. A badge as defined in claim 2, further comprising peelable film to protect the pressure adhesive exposed at the back of the badge.

4. A badge as defined in claim 1, wherein said fastening means consists of a strip coated on both faces with a pressure adhesive, one of said faces being directly adhered to the back face of said body layer.

5. A badge as defined in claim 4, further comprising a peelable film to protect the pressure adhesive exposed at the back of the badge.

6. A badge as defined in claim 1, wherein said fastening means has a metal safety pin;

7. A badge as defined in claim 1, wherein said body layer has a core of expanded polystyrene.

8. A badge as defined in claim 7, wherein said core of expanded polystyrene is sandwiched between two sheets of paper.

9. A badge having the appearance of a standard metal badge with tampered contours for wearing on a person's clothing, comprising:

a body layer of expanded polystyrene comprising a central portion and a marginal portion which extends all around said central portion and has a smaller thickness than that of said central portion, said body layer having a front face, a back face and a peripheral edge, said front face sloping toward said back face at said marginal portion to define said smaller thickness and give said front face a generally bulging configuration;

an image-bearing layer adhering to the front face of said body layer; and, fastening means carried by the back face of said body layer to attach said body layer to a wearer's clothing; wherein:

the expanded polystyrene forming the body layer is of the type having no memory when compressed;

said expanded polystyrene is left exposed at the peripheral edge of said body layer; and, said badge further comprises a protecting transparent film covering said image-bearing layer.

10. A badge having the appearance of a standard metal badge with tapered contours for wearing on a person's clothing, comprising:

a body layer of expanded polystyrene sandwiched between two sheets of paper comprising a central portion and a marginal portion which extends all around said central portion and has a smaller thickness than that of said central portion, said body layer having a front face, a back face and a peripheral edge, said front face sloping toward said back face at said marginal portion to define said smaller thickness and give said front face a generally bulging configuration;

an image-bearing layer adhering to the front face of said body layer; and, fastening means carried by the back face of said body layer to attach said body layer to a wearer's clothing, wherein;

the expanded polystyrene forming the body layer is of the type having no memory when compressed;

said expanded polystyrene is left exposed at the peripheral edge of said body layer; and, said badge further comprises a protecting transparent film covering said image-bearing layer.

* * * * *

UNITED STATES PATENT AND TRADEMARK OFFICE

CERTIFICATE OF CORRECTION

PATENT NO. : 5,050,323

DATED : September 24, 1991

INVENTOR(S) : Raymond Gagnon

It is certified that error appears in the above-identified patent and that said Letters Patent is hereby corrected as shown below:

Column 2, line 25, insert a period (--.--) after the word "blade".

Column 3, lines 32 and 33, "fastenting" should read --fastening--.

Column 4, line 55, the word "tampered" should read --tapered--.

Signed and Sealed this

Eighth Day of June, 1993

*Attest:*

Michael K. Kirk

MICHAEL K. KIRK

*Attesting Officer*

*Acting Commissioner of Patents and Trademarks*